US006701685B2

(12) United States Patent
Rippey

(10) Patent No.: US 6,701,685 B2
(45) Date of Patent: Mar. 9, 2004

(54) WATERPROOF ROOFING BARRIER

(75) Inventor: Richard L. Rippey, Lake Quivira, KS (US)

(73) Assignee: Johns Manville International, Inc., Denver, CO (US)

( * ) Notice: Subject to any disclaimer, the term of this patent is extended or adjusted under 35 U.S.C. 154(b) by 0 days.

(21) Appl. No.: 09/797,331

(22) Filed: Mar. 1, 2001

(65) Prior Publication Data

US 2002/0121061 A1 Sep. 5, 2002

(51) Int. Cl.[7] ..... E04B 5/00

(52) U.S. Cl. ..... 52/408; 52/411; 52/746.11; 52/DIG. 16; 428/40.1

(58) Field of Search ..... 52/408, 177, 181, 52/309.1, 411, 783.1, 746.11, DIG. 16; 428/40.1, 41.7, 41.8

(56) References Cited

U.S. PATENT DOCUMENTS 4,091,135 A * 5/1978 Tajima et al. ..... 428/40.3
4,172,830 A * 10/1979 Rosenberg et al. ..... 156/249
4,719,734 A * 1/1988 Fell et al. ..... 52/302
4,757,652 A * 7/1988 Kalkanoglu ..... 52/420
4,988,551 A * 1/1991 Zegler ..... 428/41.8
4,996,803 A * 3/1991 Karrfalt et al. ..... 52/180
5,142,837 A * 9/1992 Simpson et al. ..... 52/409
5,817,399 A * 10/1998 Kalman ..... 52/177
5,914,172 A * 6/1999 Kiser ..... 428/143
6,004,645 A * 12/1999 Hubbard ..... 52/180
6,131,353 A * 10/2000 Egan ..... 52/408
6,235,365 B1 * 5/2001 Schaughency et al. ..... 52/309.1
6,296,912 B1 * 10/2001 Zickell ..... 52/309.1
6,355,323 B1 * 3/2002 Iwen et al. ..... 52/411
6,426,129 B1 * 7/2002 Kalwara et al. ..... 428/41.8

FOREIGN PATENT DOCUMENTS

EP 0566544 * 4/1993 ..... E04F/15/022

* cited by examiner

*Primary Examiner*—Carl D. Friedman
*Assistant Examiner*—Chi Q. Nguyen
(74) *Attorney, Agent, or Firm*—Robert D. Touslee

(57) ABSTRACT

A shingled roof includes a waterproof roofing membrane bonded to the roof deck adjacent an eave of the roof for preventing water damage to the roof deck and an interior of a building from wind-blown rain or water buildup on the roof. The waterproof membrane underlies at least a lowermost course of shingles adjacent the roof eave; has a first major surface bonded to the roof deck; and has a second major surface with an adhesive strip extending the length of the waterproof roofing membrane that bonds the lowermost course of shingles adjacent the roof eave to the second surface of the waterproof roofing membrane. The waterproof roofing membrane has a release strip overlaying the adhesive strip which is removed immediately prior to applying and bonding the lowermost course of shingles to the waterproof roofing membrane.

7 Claims, 2 Drawing Sheets

WATERPROOF ROOFING BARRIER

BACKGROUND OF THE INVENTION

The present invention relates to a water barrier for a shingled roof that is applied to the roof deck, adjacent the eave of the roof, to prevent damage to the roof deck and an interior of a building from wind-blown rain and/or water buildup caused by ice dams or the accumulation of pine needles and leaves along the eave of the roof, and, in particular, to a waterproof roofing membrane, for application adjacent the eave of a roof, that includes an adhesive strip for bonding a lowermost course of asphalt shingles to an upper surface of the waterproof roofing membrane.

In cold climates, the eaves of a house roof or a building with a similar roof structure are normally colder than the upper portion of the roof. This difference in temperature often results in the buildup of snow and water at the eaves of the roof which freezes to form ice dams at the eaves. Water backs up behind the ice dams and, left standing behind the ice dams, leaks down around the nails securing shingles to the roof deck and damages the roof deck and the interior of the home or other building. In warmer climates a buildup of pine needles and leaves along the eaves of a roof can also form a dam that causes a water buildup on the roof which, left standing, leaks down around the nails securing shingles to the roof deck to damage the roof deck and the interior of the home or other building.

To prevent potential costly water damage from water buildup on a roof, waterproof roofing membranes are installed on the roof deck along the lengths of the roof eaves and extending upward from the lower edges of the roof eaves. To provide a waterproof barrier that protects the vulnerable part of the roof from water buildup caused by the presence of ice dams or pine needle and leaf dams, these waterproof roofing membranes are typically about 36 inches wide; are bonded to the deck along the lengths of the roof eaves; and seal around the shanks of nails used to secure asphalt shingles to the roof deck. Examples of such waterproof roofing membranes are waterproof roofing membranes sold by Johns Manville International, Inc., under the trade designations "ROOF DEFENDER" waterproofing membranes and "NORDSHIELD and SURE GRIP" waterproofing membranes.

When applying a lowermost course of asphalt shingles to a roof deck over one of these waterproof roofing membranes, a typical procedure followed by roofers to help seal and hold down the lowermost course of asphalt shingles at an eave edge, where the lift from winds may be the most severe, includes the following steps. Tabs are cut off or removed from a number of asphalt shingles whose combined length equals the length of the eave. The remainder of each asphalt shingle, typically about half of the asphalt shingle in width, is inverted or turned upside down so that the adhesive on what is normally the underside of the shingle, typically used to help secure the asphalt shingle to an underlayment, faces upward and these half shingles are nailed to the roof deck along the lower edge of the eave for the length of the eave. The first or lowermost course of full size asphalt shingles is then applied over these partial asphalt shingles and nailed to the roof deck with the adhesive on the now upper surfaces of the inverted partial asphalt shingles bonding to the undersides of the lowermost course of full size asphalt shingles to help seal and hold the lowermost course of asphalt shingles in place on the roof deck. While this procedure for applying the lowermost course of full size asphalt shingles to a roof deck is effective, the procedure is labor intensive and time consuming and there has remained a need to help seal and hold down a lowermost course of asphalt shingles on a roof deck that eliminates or greatly reduces the time and labor required to prepare the roof for the application of the lowermost course of full size shingles to the roof deck.

SUMMARY OF THE INVENTION

The waterproof roofing membrane of the present invention provides an inexpensive, labor and time saving solution to the above discussed problems. The waterproof roofing membrane of the present invention, which prevents water damage to a roof deck and an interior of a building through leakage from water buildup on an asphalt shingled roof, is preferably made of a fibrous mat, e.g. a glass fiber mat, saturated with a bituminous material. The waterproof roofing membrane is both waterproof and seals around nail penetrations through the membrane to form a watertight barrier.

The waterproof roofing membrane includes a first major surface with an adhesive thereon for bonding the waterproof roofing membrane to a roof deck along a lower portion of the roof deck adjacent the lower edge of the eave of the roof deck and a second major surface with an adhesive strip thereon for sealing a lowermost course of asphalt shingles to the membrane and helping to hold down this course of shingles which is more susceptible than other courses of shingles to being lifted off the roof deck by high winds. Preferably, the adhesive on the first major surface of the waterproof roofing membrane is coextensive with the first major surface of the membrane. A release sheet or film, which is removed immediately prior to applying and bonding the waterproof roofing membrane to a roof deck, covers the adhesive during storage, shipment and handling. Preferably, the adhesive on the second major surface of the waterproof roofing membrane is a strip of adhesive extending for the length of the membrane adjacent a lateral edge of the membrane adapted to be the lower lateral edge of the membrane, i.e. a lateral edge of the membrane that extends along the lower edge of a roof eave when the membrane is installed. The adhesive strip is a generally continuous layer or a patterned layer. A release sheet or film, which is removed immediately prior to applying and bonding the lowermost course of asphalt shingles to the waterproof roofing membrane, covers the adhesive layer during storage, shipment and handling.

DESCRIPTION OF THE PREFERRED EMBODIMENTS

Figure 1:
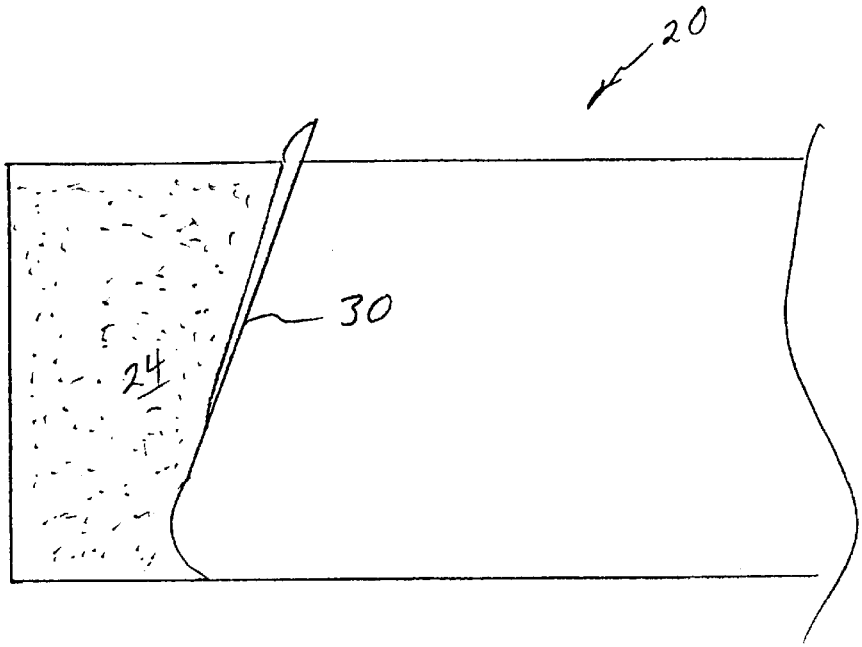
FIG. 1 is a schematic view of a first major surface of a waterproof roofing membrane of the present invention with the release sheet partially peeled away from the surface.
Figure 2:
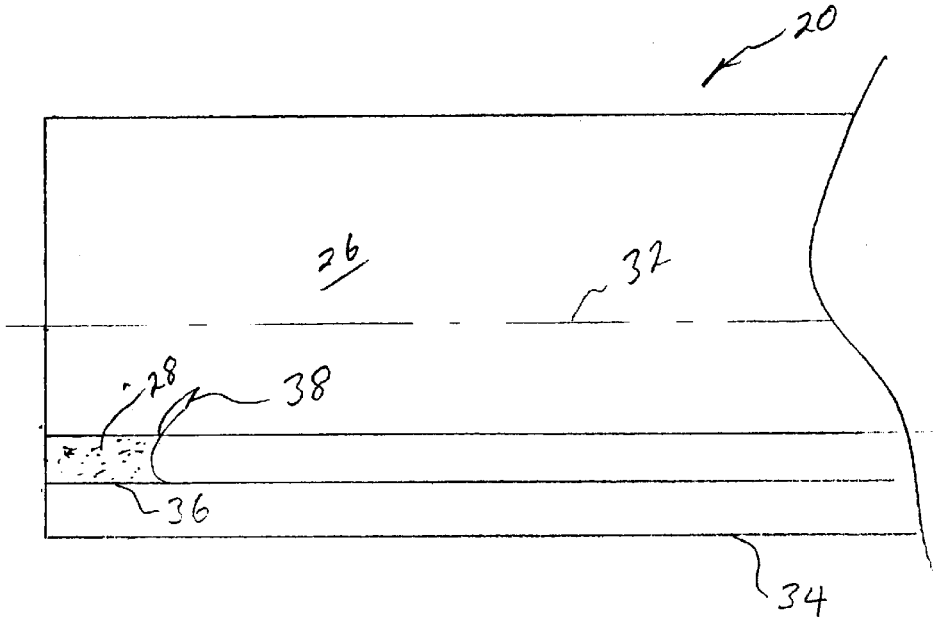
FIG. 2 is a schematic view of a second major surface of a waterproof roofing membrane of the present invention with the release sheet partially peeled away from adhesive strip on the surface.
Figure 3:
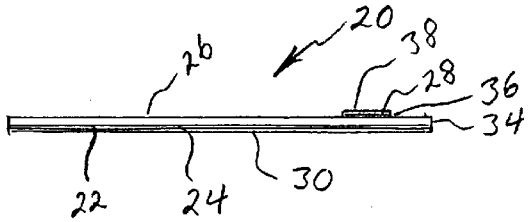
FIG. 3 is a schematic end view of the waterproof roofing membrane of FIGS. 1 and 2.

As schematically shown in FIGS. 1–3, the waterproof roofing membrane 20 of the present invention includes a first major surface 22 with an adhesive 24 thereon for bonding the waterproof roofing membrane to a roof deck along a lower portion of the roof deck adjacent the lower edge of the eave of the roof deck and a second major surface 26 with an adhesive strip 28 thereon for sealing a lowermost course of asphalt shingles to the membrane and helping to hold down this course of shingles which is more susceptible than other courses of shingles to being lifted off the roof deck by high winds. Typically, the waterproof roofing membrane 20 is about thirty six inches wide, and comes in lengths of about thirty three feet or sixty seven. The first and second major surfaces 22 and 26 of the waterproof roofing membrane 20 are defined by the length and width of the waterproof roofing membrane.

The waterproof roofing membrane 20 is made of a woven or non-woven fibrous mat, e.g. a glass fiber mat, which has been saturated by a bituminous material. The waterproof roofing membrane is both waterproof and seals around nails passing through the membrane to form a watertight barrier. Examples of waterproof roofing membranes which can be used as the membrane of the waterproof roofing membrane 20 of the present invention, are waterproof roofing membranes sold by Johns Manville International, Inc., under the trade designations "ROOF DEFENDER" waterproofing membranes and "NORDSHIELD and SURE GRIP" waterproofing membranes.

Preferably, the adhesive layer or coating 24 (hereinafter "layer") on the first major surface 22 of the waterproof roofing membrane 20 for bonding or adhering the waterproof roofing membrane to a roof deck is coextensive with the first major surface 22 of the membrane and is formed by the mastic or bituminous material with which the fibrous mat of the membrane is saturated.

A release sheet or film 30 covers the adhesive layer 24 during the storage, shipment and handling of the waterproof roofing membrane 20. The release sheet 30 may be made of kraft paper, a polymeric film or some other sheet material which has the major surface that is in contact with the adhesive layer 24 treated with a silicone, a fluorocarbon polymer such a "TEFLON" or some other release agent with non-sticking properties that enables the release sheet 30 to be easily peeled away from the adhesive layer 24 immediately prior to applying and bonding the waterproof roofing membrane 20 to a roof deck.

Preferably, the adhesive on the second major surface 26 of the waterproof roofing membrane 20 is a continuous or patterned strip 28 of adhesive about one to about six inches wide, more preferably about two to about four inches wide, and extending for the length of the membrane. Preferably, the adhesive strip 28 is located intermediate a longitudinal centerline 32 of the waterproof roofing membrane and a lateral edge 34 of the waterproof roofing membrane adapted to be a lower edge of the waterproof roofing membrane with the lower edge 36 of the adhesive strip 28 being from about two inches to about seven inches from the lateral edge 34 of the waterproof roofing membrane 20. Preferably, the adhesive used to form the adhesive strip 28 on the second major surface 26 of the waterproof roofing membrane 20 is a mastic or other sticky substance that causes a course of shingles to bond or adhere to the waterproof roofing membrane 20 when the shingles are applied to the waterproof roofing membrane.

A release sheet or film 38, which preferably has a width about equal to the width of the adhesive strip 28, covers the adhesive strip 28 during the storage, shipment and handling of the waterproof roofing membrane 20. The release sheet 38 may be made of kraft paper, a polymeric film or some other sheet material which has the major surface that is in contact with the adhesive strip 28 treated with a silicone, a fluorocarbon polymer such a "TEFLON" or some other release agent with non-sticking properties that enables the release sheet 38 to be easily peeled away from the adhesive strip 28 immediately prior to applying and bonding a course of shingles to the waterproof roofing membrane 20.

Figure 4:
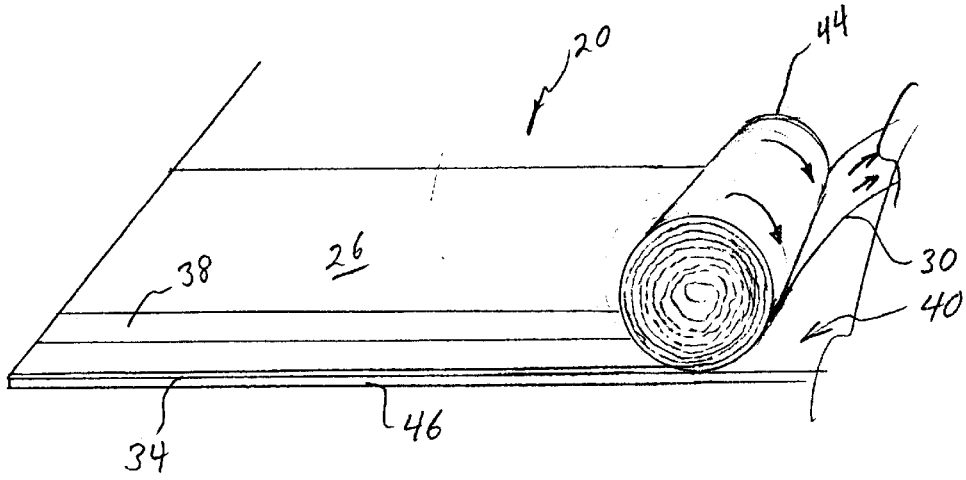
FIG. 4 is a schematic perspective view of a waterproof roofing membrane of the present invention being applied to a lower portion of a roof deck adjacent a lower edge of the roof deck with the release sheet being peeled away from the membrane immediately prior to applying and bonding the membrane to the deck.
Figure 5:
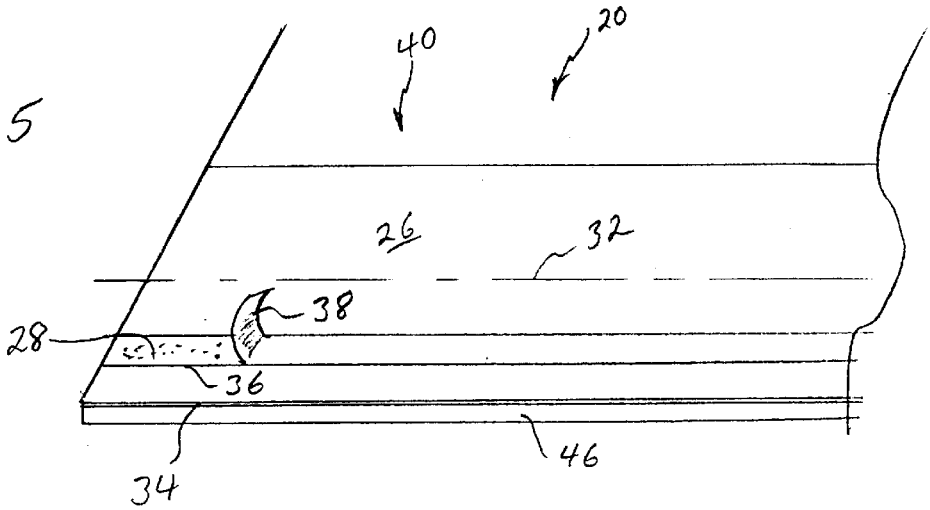
FIG. 5 is a schematic perspective view of a waterproof roofing membrane of the present invention that has been applied to a lower portion of a roof deck adjacent a lower edge of the roof deck with the release sheet that covers the adhesive strip on the second major surface of the membrane being peeled away from the adhesive strip immediately prior to applying and bonding a first course of asphalt shingles to the membrane.
Figure 6:
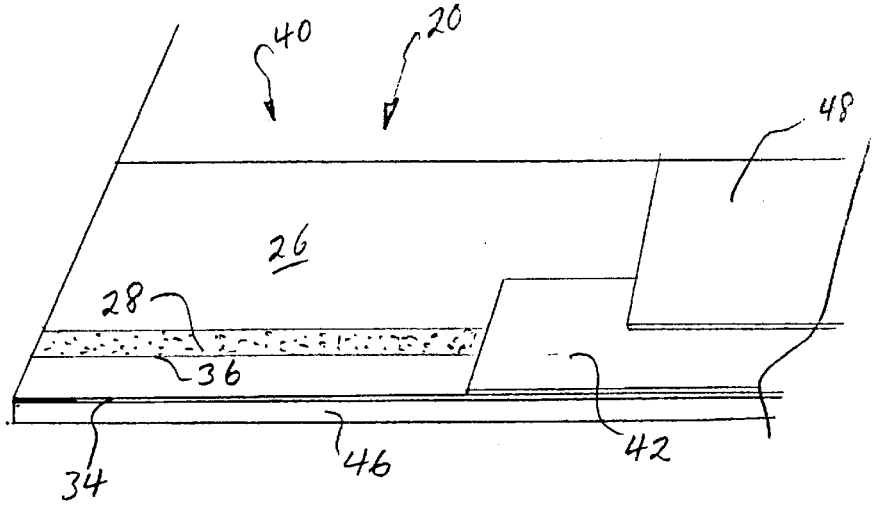
FIG. 6 is a schematic perspective view of a waterproof roofing membrane of the present invention that has been applied to a lower portion of a roof deck adjacent a lower edge of the roof deck with a part of a first course of asphalt shingles bonded to the adhesive strip of the membrane.

FIGS. 4 to 6 schematically show the waterproof roofing membrane 20 of the present invention being applied and bonded to a roof deck 40 and a lowermost course of shingles 42 being applied and bonded to the waterproof roofing membrane 20. As shown in FIG. 4, the waterproof roofing membrane 20 is being unrolled from of roll 44 of the waterproof roofing membrane and applied and bonded to the roof deck 40. The waterproof roofing membrane is applied to a lower portion of the roof deck 40, adjacent the lower edge 46 of the roof or eave, with the lower lateral edge 34 of the waterproof roofing membrane at or adjacent and extending for the length of the lower edge 46 of the roof or eave. Immediately prior to applying and bonding the waterproof roofing membrane 20 to the roof deck 40, the release sheet 30 is peeled away from the adhesive layer 24 on the first major surface of the waterproof roofing membrane to expose the adhesive layer 24.

With the waterproof roofing membrane 20 bonded to the roof deck 40 and covering a lower portion of the roof deck adjacent the lower edge 46 of the roof or eave, as shown in FIG. 5, the release sheet 38 is removed from the adhesive strip 28. Next the lowermost course of shingles 42 is applied and bonded to the waterproof roofing membrane 20 by the adhesive strip 28, as shown in FIG. 6, and the lowermost course of shingles 42 and additional courses of shingles 48 are secured to the roof.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A waterproof roofing membrane for preventing water damage to A roof deck and an interior of a building from water buildup on a shingled roof and for bonding a lowermost course of shingles to a roof deck, comprising:

a waterproof roofing membrane for overlaying a lower portion of a roof deck adjacent a lower edge of a roof save and underlying at least a lowermost course of shingles adjacent a lower edge of a roof save; the waterproof roofing membrane having a longitudinal centerline, a length and a width of about 36 inches;

the waterproof roofing membrane having a first major surface defined by the length and the width of the waterproof roofing membrane; the first major surface of the waterproof roofing membrane having an adhesive thereon for bonding the waterproof roofing membrane to a lower portion of a roof deck adjacent a lower edge of a roof eave; a first release strip overlaying the adhesive on the first major surface of the waterproof roofing membrane to be removed immediately prior to applying and bonding the first major surface of the waterproof roofing membrane to a lower portion of a roof deck adjacent a lower edge of a roof eave; and the roofing membrane having a second major surface defined by the length and the width of the waterproof roofing membrane; the second major surface to the waterproof roofing membrane having an adhesive ski the length of the waterproof roofing membrane; the adhesive strip being spaced from the longitudinal centerline and located at between the longitudinal centerline and a lateral edge of the waterproof roofing membrane adapted to be a lower edge of the waterproof roofing membrane for bonding a lowermost course of shingles to the second major surface of the waterproof roofing membrane adjacent a lower edge of a roof eave; the adhesive strip being from about one inch to about six inches in width; the adhesive strip having a lower edge spaced from about two inches to about seven inches from the lateral edge of the waterproof roofing membrane adapted to be the lower edge of the waterproof roofing membrane; and a second release strip overlaying the adhesive strip to be removed immediately prior to applying and bonding a lowermost course of shingles to the second major surface of the waterproof roofing membrane; and the waterproof roofing membrane is a membrane that seals around nails passing through the membrane to form a watertight barrier.

2. The waterproof roofing membrane according to claim 1, wherein:

the adhesive strip is a continuous adhesive strip.

3. The waterproof roofing membrane according to claim 1, wherein:

the adhesive strip is a patterned adhesive strip.

4. The waterproof roofing membrane according to claim 1, wherein:

the waterproof roofing membrane is a fibrous mat saturated with a bituminous material.

5. A roof with a waterproof roofing membrane for preventing water damage to a roof deck and an interior of a building from water buildup on a shingled roof and for bonding a lowermost course of shingles to a roof deck, comprising:

a roof deck with an eave;

a fibrous mat saturated with a bituminous material and forming a waterproof roofing membrane overlaying the roof deck adjacent the roof eave and adapted to underlay at least a lowermost course of shingles adjacent the roof eave; the waterproof roofing membrane having a longitudinal centerline, a length and a width of about 36 inches;

the waterproof roofing membrane having a first major surface, defined by the length and the width of the waterproof roofing membrane, bonded to the roof deck by an adhesive layer of the first major surface of the waterproof roofing membrane;

the roofing membrane having a second major surface defined by the length and the width of the waterproof roofing membrane; the second major surface to the waterproof roofing membrane having an adhesive strip extending the length of the waterproof roofing membrane for bonding a lowermost course of shingles adjacent the roof eave to the second surface of the waterproof roofing membrane; the adhesive strip being spaced from the longitudinal centerline and located between the longitudinal centerline and a lateral edge of the roofing membrane and a lower edge of the waterproof roofing membrane; the adhesive strip being from about one inch to about six inches in width; the adhesive strip having a lower edge spaced from about two inches to about seven inches from the lateral edge of the waterproof roofing membrane adapted to be the lower edge of the waterproof roofing membrane; and a release strip overlaying the adhesive strip to be removed immediately prior to applying and bonding a lowermost course of shingles to the second major surface of the waterproof roofing membrane; and the waterproof roofing membrane is a membrane that seals around nails passing through the membrane to form a watertight barrier.

6. The roof according to claim 5, wherein:

the adhesive strip is a continuous adhesive strip.

7. The roof according to claim 5, wherein:

the adhesive strip is a patterned adhesive strip.

* * * * *